United States Patent [19]

Patel

[11] 3,985,987

[45] Oct. 12, 1976

[54] MEANS FOR RECYCLING LIQUIFIED INSULATING GAS IN A GAS INSULATED CIRCUIT BREAKER

[75] Inventor: Amrut R. Patel, Brandon, Miss.

[73] Assignee: Allis-Chalmers Corporation, Milwaukee, Wis.

[22] Filed: July 31, 1975

[21] Appl. No.: 600,782

[52] U.S. Cl. ..... 200/148 E; 174/11 R; 200/84 B

[51] Int. Cl.[2] ..... H01H 33/57

[58] Field of Search ..... 200/148 G, 148 E, 84 R, 200/84 B; 174/11 R

[56] References Cited

UNITED STATES PATENTS

| | | | |
|---|---|---|---|
| 3,622,725 | 11/1971 | McConnell | 200/148 E |
| 3,686,451 | 8/1972 | Pottharst, Jr. | 200/84 R |
| 3,846,602 | 11/1974 | Hoffmann | 200/148 E |

FOREIGN PATENTS OR APPLICATIONS

| | | | |
|---|---|---|---|
| 1,176,991 | 12/1958 | France | 200/84 B |

*Primary Examiner*—Robert S. Macon
*Attorney, Agent, or Firm*—Robert C. Jones

[57] ABSTRACT

Liquid $SF_6$ from the high pressure storage tanks within the gas sealed enclosure of a multi-interrupter gas insulated circuit breaker is collected in a tank located externally of the circuit breaker enclosure. A float within the liquid collecting tank operates a micro switch to effect operation of a solenoid actuated valve to pass the liquid $SF_6$ into the low pressure system of the circuit breaker wherein it again returns to its gaseous state. The collected $SF_6$ gas in the low pressure system is pumped back into the high pressure system through a compressor.

6 Claims, 2 Drawing Figures

MEANS FOR RECYCLING LIQUIFIED INSULATING GAS IN A GAS INSULATED CIRCUIT BREAKER

BACKGROUND OF THE INVENTION

Metal-clad gas insulated electrical switching equipment have a grounded metallic enclosure which contains an insulating gas such as sulfur-hexafluoride ($SF_6$) gas at a relatively low pressure to isolate the electrical conducting components from the enclosure. Storage tanks for storing the insulating gas at a relatively high pressure are also contained within the enclosure. This gas upon a lowering of the ambient temperature will convert to its liquid phase causing a loss of its effective interruption value. The reclaiming of the liquified insulating gas and the replenishing of the insulating gas in the high pressure storage tanks has been a problem which the present invention solves.

DESCRIPTION OF THE PRIOR ART

To overcome the insulating gas liquifying problem thermostatically controlled heaters have been applied to the storage tanks to raise tank temperatures when the ambient temperature falls. However, this method introduces another problem of how and where to read the temperature. Temperature reading or sensing is of importance with heater systems so that the heaters may be turned on and off at the proper times. A false temperature reading may turn the heater on prematurely causing a pressure drop. Alternately, a false reading which is influenced by the heaters themselves or by other sources of heat may result in the insulating gas liquifying even though the temperature sensor or indicator registers a proper temperature.

In U.S. Pat. No. 3,846,602, a floating needle valve arrangement opens an orifice to permit liquified gas to drain to a pressure container wherein it converts back to its gas phase. A compressor draws the gas from the container and forces it back into the chamber from which the liquified gas drained. However, the above-mentioned needle valve arrangement is not a positive arrangement and can easily malfunction and there is no means to utilize the system for replenishing the high pressure source with gas.

SUMMARY OF THE INVENTION

It is the general object of the present invention to provide a means for releasing liquified insulating gas from a high pressure system which is simple in construction, relatively inexpensive and provides positive control.

Accordingly, to the present invention the several high pressure storage tanks of a gas insulated circuit breaker in which insulating gas is stored and in which high pressure must be maintained, is connected by piping to a common drain conduit leading to a liquid collecting tank. Within the collecting tank there is provided a float which is contained for straight line vertical movement. A predetermined upward movement of the float will positively actuate a micro switch which when actuated effects the energization of solenoid valve to open the valve. The solenoid valve is connected in a conduit leading from the collecting tank to the low pressure enclosure of the circuit breaker and when open permits the flow of the liquified gas to the low pressure enclosure wherein it returns to its gaseous phase.

Advantage is taken of the gas return conduit which leads from the collecting tank to the low pressure enclosure to connect a compressor unit into the return conduit. Thus, at any time that low pressure is encountered in the high pressure components such as the interrupter high pressure gas storage tanks, the compressor will be operated and will draw the gas at a relatively low pressure out of the low pressure enclosure until the high pressure demand has been satisfied. This eliminates the necessity for a separate piping arrangement between the low pressure enclosure and the compressor as is presently provided. Thus, additional cost reduction can be accomplished.

DESCRIPTION OF THE INVENTION

Figure 1:
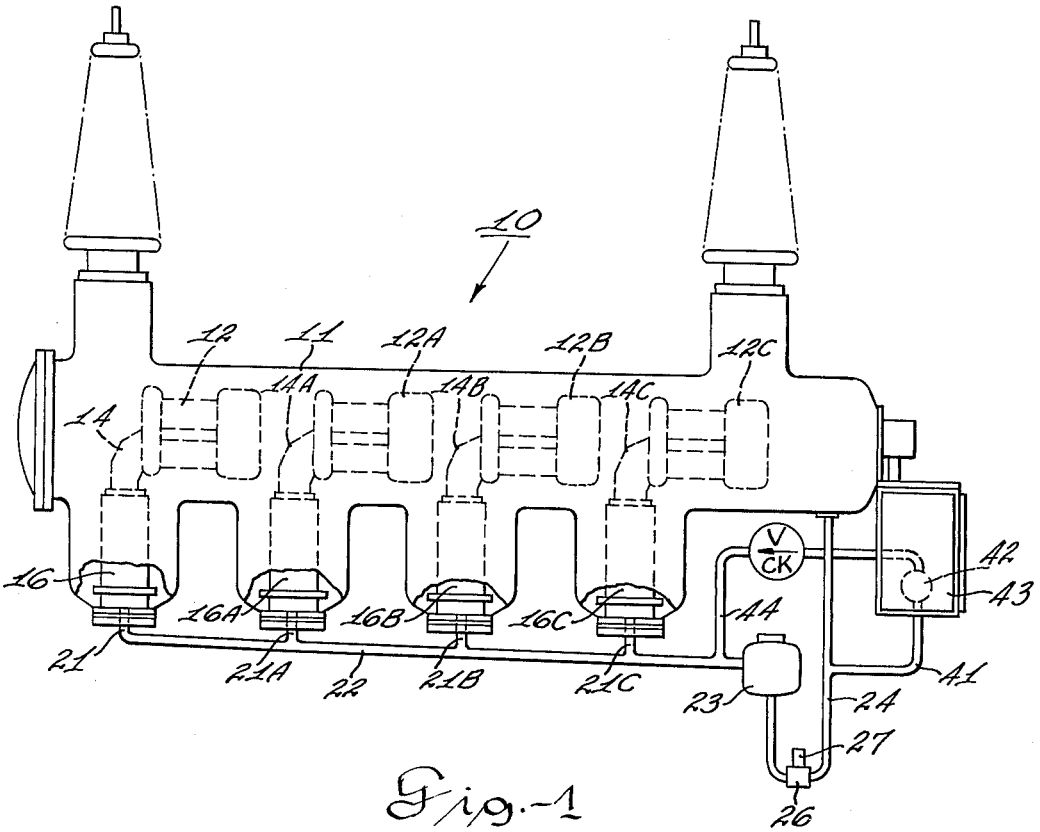
FIG. 1 is a view in elevation of a gas insulated circuit breaker in which the invention is incorporated; and, FIG. 2 is a detail view partly in vertical section and partly in elevation showing the liquid gas release system of the present invention.
Figure 2:
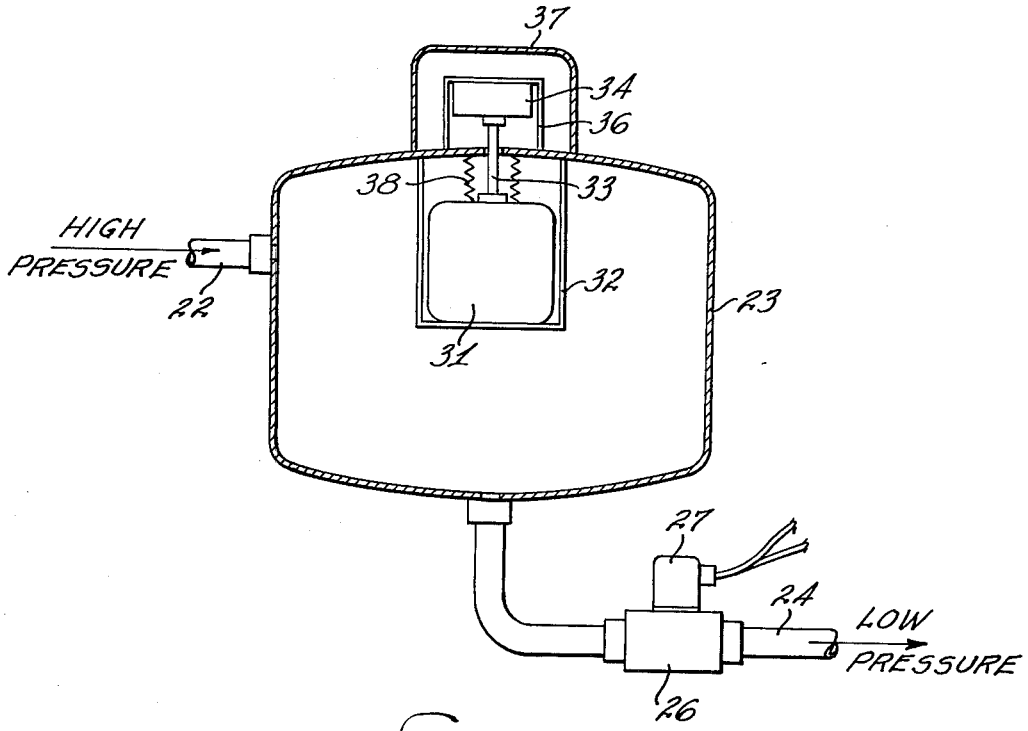

Referring to FIG. 1, a gas insulated circuit breaker 10 in which the present invention is incorporated to good advantage. The circuit breaker 10 includes a grounded gas tight enclosure 11 in which a plurality of serially connected interrupters 12 are disposed. Each interrupter includes a blast valve unit 14 that is operable when actuated to direct a blast of high pressure gas to the area of arcing of the associated interrupter. A supply of gas at a relatively high pressure is contained in a storage tank 16 associated with each interrupter and blast valve unit. Insulating gas at a relative low pressure is contained within the enclosure 11 and serves to insulate the electrical components from the walls of the enclosure.

The insulating gas herein being sulfur hexafluoride ($SF_6$) has many advantageous qualities, one of which is that at pressures up to 35 psig it will remain in a gaseous state, at temperatures as low as −40° F. Thus, since the pressure of the gas within the enclosure is at a relatively low pressure there is no need to heat the enclosure to maintain the $SF_6$ in its gaseous phase. However, a different problem is posed with the gas in the storage tanks 16. Within the storage tanks the gas is maintained therein at a pressure of about 250 psig at 70° F. This pressure is necessary so that a blast of gas emitted from the blast valve units 14 and directed to the area of arcing of the interrupters 12 will have a force sufficient to extinguish the arcs. $SF_6$ at 250 psig will remain in its gaseous state at a temperature as low as 50° F. However, the circuit breaker 10 may well be installed in locations where the ambient temperature is below 50° F. Thus, as has been previously mentioned, thermostatically controlled heaters are usually employed to maintain the gas in the high pressure tanks at a desirable temperature level. The installation and operation of these heaters are costly and their temperature effect on the storage tanks vary depending upon the placement.

To avoid the use of heaters the liquified gas in the storage tanks 16 drains via connected piping or conduits 21 into a common high pressure drain line or conduit 22. The common drain line 22 is connected to communicate with the interior of a collecting tank 23. It will be noted that the common drain line 22 slopes downwardly from left to right, as viewed in FIG. 1, to insure complete and easy flow of the liquified gas to the collecting tank 23. The collected liquified gas in the collecting tank 23 is directed into the low pressure enclosure 11 via conduit 24. Interposed in the conduit 24 is a solenoid actuated valve 26, the solenoid thereof being normally deenergized so that the valve is closed blocking flow through the conduit 24. This arrangement prevents the exhausting of high pressure gas and liquified gas from the storage tank 16 and collecting tank 23 into the enclosure 11 via the conduit 24, until such time as a predetermined quantity of the liquified gas has been collected in tank 23. When a predetermined quantity of liquified gas has been accumulated in the tank 23 the solenoid of the valve 26 will be energized to open the valve allowing the liquified gas under relatively high pressure to flow via conduit 24 into the low pressure area of the enclosure 11.

Energization of the solenoid 27 associated with the valve 26 is accomplished when a predetermined amount of liquified gas is collected in the collecting tank 23. To this end, a float 31 is disposed within a cage 32 is secured in depending relationship from the undersurface of the top of the collecting tank 23. The cage 32 serves to restrict the movement of the float 31 to a substantially vertical path of travel. A rod 33 carried by the float 31 is disposed in engagement with an actuating element of a micro switch 34. As shown, the micro switch 34 is carried by a bracket 36 that is secured to the top of the collecting tank 23. A protective cover 37 encases the micro switch to prevent accidental damage thereof.

As the quantity of the liquified gas collected in the tank 23 increases beyond a predetermined level, the float 31 will rise. The upward movement of the float 31 will effect a like upward movement of the rod 33. When the float reaches a predetermined upper limit the actuating member of the micro switch 34 will be operated to actuate the micro switch 34. The micro switch 34 is electrically connected into the circuit (not shown) of the solenoid 27 associated with the valve 26. Thus, the micro switch 34 upon being actuated effects the energization of the solenoid 27 to thereby open the valve 26. Since the liquified gas collected in the tank 23 is at a higher pressure than the pressure in the enclosure 11, the liquified gas will be rapidly forced out of the tank and into the enclosure 11. The liquified gas forced into the low pressure enclosure 11 will return to its gaseous state. When the liquified gas level falls, the float will likewise fall releasing the micro switch and thereby deenergizing the solenoid 27 to close the valve 26.

The liquified gas draining from the high pressure storage tank 16 is at a higher pressure than that which is maintained in the storage tank 23. This is true because there is no blocking valve interposed between the storage tank 16 and the solenoid valve 26. Thus, the high pressure system includes the collecting tank 23. To prevent blow-out of the liquified gas under relatively high pressure from the collecting tank 23 and the accompanying loss of pressure a flexible bellow seal 38 is provided. The bellow seal 38 is disposed to surround the rod 33 and has its lower end secured in sealed relationship to the top surface of the float 31. The upper axial end of the bellow seal 38 encompasses the opening in the top of the collecting tank through which the rod 33 extends and is secured in sealed relationship to the undersurface of the top of the collecting tank. Thus, the integrity of the high pressure system is maintained.

As shown in FIG. 1, advantage has been taken of the return conduit 24 that is connected to the enclosure 11, and is used as a supply line when it is necessary to replenish the storage tank 16. To this end, one end of a conduit 41 is connected to the conduit 24. The opposite end of conduit 41 is connected to the low pressure side of a compressor 42 that is located in a control cabinet 43. Another conduit 44 has one end connected to the high pressure side of the compressor 42 and has its opposite end connected to the common drain conduit 22. When it is necessary to replenish the storage tank 16, the compressor 42 is turned on, either automatically or manually. When the compressor is turned on, the circuit (not shown) in which the solenoid is connected is inactivated to prevent the valve 26 from being open inadvertently while the compressor 42 is operating. Operation of the compressor 42 will draw the insulating gas at relatively low pressure out of the enclosure 11 and will pump the gas at a relatively high pressure into the conduit 44. Since the valve 26 is deactuated, it blocks the conduit 24 so that the gas at high pressure in the line 44 is forced into the common drain conduit 22 and thence into the storage tank 16 to replenish one or more of the storage tanks as required. When the pressure in the storage tanks 16 is at the desired level, the compressor is turned off and the solenoid 27 associated with the valve 26 is operative again.

The embodiments of the invention in which an exclusive property or privilege is claimed are defined as follows:

1. In a gas insulated circuit breaker including a gas sealed enclosure having insulating gas at a relatively low pressure therein and in which an interrupter and an associated blast valve unit is disposed;

a storage tank having insulating gas at a relatively high pressure therein for arc interruption, said storage tank being operably connected to supply insulating gas at relatively high pressure to the blast valve unit;

a collecting tank external of the enclosure, said collecting tank having an inlet and an outlet;

first conduit means connected to said storage tank and to the inlet of said collecting tank to drain liquified insulating gas at a relatively high pressure from said storage tank into said collecting tank;

second conduit means connecting the outlet of said collecting tank to the enclosure for directing the collected liquified insulating gas from said tank to enclosure wherein the liquified insulating gas returns to its gaseous state;

valve means on the outlet side of the collecting tank and normally operable to block the flow of liquified insulating gas through said second conduit means, said valve means being operable when actuated to permit the flow of liquified insulating gas through said second conduit means; and, operable means actuated by liquified insulating gas within said collecting tank exceeding a predetermined quantity to actuate said valve means;

whereby the quantity of liquified insulating gas collected in said collecting tank is forced under relatively high pressure into the relatively low pressure area of the enclosure and returns to its gaseous state therein.

2. A gas insulated circuit breaker according to claim 1 wherein said valve means is a solenoid operated valve normally in flow blocking condition when the solenoid is deenergized, said valve being operated to an open condition when the solenoid is energized; and said operable means includes a micro switch carried by said collecting tank in position to be actuated by the liquified insulating gas exceeding a predetermined quantity in said collecting tank, said micro switch being connected to the solenoid of said solenoid valve in a manner that actuation of said micro switch effects the energization of the solenoid of said solenoid valve to open the valve.

3. A gas insulated circuit breaker according to claim 2 wherein said micro switch is actuated by a displaceable member within the collecting tank which moves in response to the collected liquified insulating gas exceeding a predetermined quantity.

4. A gas insulated circuit breaker according to claim 1 wherein there is provided means for withdrawing insulating gas from the circuit breaker enclosure and recharging said storage tank with the withdrawn gas at a relatively high pressure.

5. A gas insulated circuit breaker according to claim 4 wherein the means for withdrawing insulating gas from the circuit breaker enclosure includes a compressor;

a third conduit connected to said second conduit and to the low pressure side of said compressor; and, a fourth conduit connected to said first conduit and to the high pressure side of said compressor;

whereby insulating gas from the circuit breaker enclosure may be withdrawn and pumped back into storage tank at relatively higher desired pressure through the same conduit that the liquified insulating gas drains from the storage tank into the collecting tank.

6. A gas insulated circuit breaker according to claim 5 wherein said valve means is made inoperable when said compressor is operating to thereby block the recirculation of the insulating gas through said collecting tank.

* * * * *